US011256206B2

(12) United States Patent
Zhang et al.

(10) Patent No.: US 11,256,206 B2
(45) Date of Patent: Feb. 22, 2022

(54) ELECTRICAL PARAMETER DETECTION METHOD, CHIP, CONSUMABLE, AND IMAGE FORMING APPARATUS

(71) Applicant: Zhuhai Pantum Electronics Co., Ltd., Zhuhai (CN)

(72) Inventors: Hao Zhang, Zhuhai (CN); Aiguo Yin, Zhuhai (CN)

(73) Assignee: Zhuhai Pantum Electronics Co., Ltd., Zhuhai (CN)

( * ) Notice: Subject to any disclaimer, the term of this patent is extended or adjusted under 35 U.S.C. 154(b) by 0 days.

(21) Appl. No.: 17/361,305

(22) Filed: Jun. 28, 2021

(65) Prior Publication Data

US 2021/0325813 A1 Oct. 21, 2021

Related U.S. Application Data

(63) Continuation-in-part of application No. PCT/CN2019/122618, filed on Dec. 3, 2019.

(30) Foreign Application Priority Data

Dec. 29, 2018 (CN) ..... 201811642461.3
Aug. 30, 2019 (CN) ..... 201910817052.0

(51) Int. Cl.
*G03G 15/00* (2006.01)
*G03G 21/16* (2006.01)
*G03G 21/18* (2006.01)

(52) U.S. Cl.
CPC ..... *G03G 15/80* (2013.01); *G03G 21/1619* (2013.01); *G03G 21/1652* (2013.01); (Continued)

(58) Field of Classification Search
CPC ..... G03G 15/80; G03G 21/1619; G03G 21/1652; G03G 21/1671; G03G 21/1676; (Continued)

(56) References Cited

U.S. PATENT DOCUMENTS

2019/0196394 A1* 6/2019 Yabuki ..... G03G 21/1652

FOREIGN PATENT DOCUMENTS

CN 101887233 A 11/2010
CN 201897696 U 7/2011
(Continued)

OTHER PUBLICATIONS

The World Intellectual Property Organization (WIPO) International Search Report With Translation and Written Opinion for PCT/CN2019/122618 dated Feb. 20, 2020 6 Pages (including translation).

(Continued)

*Primary Examiner* — Sophia S Chen
(74) *Attorney, Agent, or Firm* — Anova Law Group, PLLC

(57) ABSTRACT

The present disclosure provides an electrical parameter detection method, a chip, a consumable, and an image forming apparatus. The electrical parameter detection method includes: configuring an installation detecting pin to be at a high level by an image forming control unit; controlling a voltage of an installation detecting terminal to be at a low level by a chip control unit, such that a current loop is formed between the image forming apparatus and the chip; and determining, by the image forming apparatus, whether the image forming apparatus is in a desired contact with the chip according to an electrical parameter of the current loop.

22 Claims, 6 Drawing Sheets

(52) U.S. Cl.
CPC ..... *G03G 21/1671* (2013.01); *G03G 21/1676* (2013.01); *G03G 21/1875* (2013.01); *G03G 2215/00632* (2013.01)

(58) Field of Classification Search
CPC ..... G03G 21/1875; G03G 21/1892; G03G 2215/00632
See application file for complete search history.

(56) References Cited

FOREIGN PATENT DOCUMENTS

| | | | | |
|---|---|---|---|---|
| CN | 103802483 | A | 5/2014 | |
| CN | 109613809 | A | 4/2019 | |
| CN | 110412852 | A | 11/2019 | |
| GB | 2499325 | A | 8/2013 | |
| WO | WO-2019072108 | A1 * | 4/2019 | ..... G03G 15/80 |

OTHER PUBLICATIONS

The China National Intelleectual Property Administration (CNIPA) the China Search Report for 201910817052.0 dated Mar. 24, 2020 56 Pages.

* cited by examiner

ELECTRICAL PARAMETER DETECTION METHOD, CHIP, CONSUMABLE, AND IMAGE FORMING APPARATUS

CROSS-REFERENCE TO RELATED APPLICATIONS

This application is a continuation-in-part of International Application No. PCT/CN2019/122618, filed on Dec. 3, 2019, which claims priority of Chinese Patent Application No. 201811642461.3, filed on Dec. 29, 2018, and claims priority of Chinese Patent Application No. 201910817052.0, filed on Aug. 30, 2019, the entire content of all of which is incorporated herein by reference.

FIELD OF THE DISCLOSURE

The present disclosure generally relates to the technical field of image forming and, more particularly, relates to an electrical parameter detection method, a chip, a consumable, and an image forming apparatus.

BACKGROUND

With the development of image forming technology, image forming apparatuses, as a type of computer peripheral equipment, have gradually gained popularity in offices and homes because of advantages such as high speed, low cost of single-page image forming and the like. According to different functions, the image forming apparatuses may include printers, copiers, multifunction machines and the like. According to different image forming principles, the image forming apparatuses may include laser printers, inkjet printers, dot matrix printers and the like.

The image forming apparatus may normally be equipped with consumables that need to be replaced. Taking the laser printer as an example, the consumables may include a processing cartridge or a developing cartridge for containing developer, a drum assembly, a fixing assembly, a paper holding unit and the like. Taking the inkjet printer as an example, the consumables may include an ink cartridge or an ink container and the like. Taking the dot matrix printer as an example, replaceable units may include a ribbon box and the like. When a consumable is not installed in a preset position as required, the consumable may not be appropriately matched with other components in the image forming apparatus; or when an incorrect type consumable is installed in the image forming apparatus, it may also result in that the consumable may not be appropriately matched with other components in the image forming apparatus; or even if an incorrect type consumable is installed and can be structurally matched with other components in the image forming apparatus, the incorrect type consumable may not meet the image forming requirements of the image forming apparatus, which may result in declined image forming quality. In order to prevent the consumable from not being installed in the preset position in the image forming apparatus or the incorrect type consumable from being installed in the image forming apparatus, the consumable may be normally provided with a chip which matches the main body of the image forming apparatus to detect the consumable characteristics in the existing technology.

For example, an invention with the Chinese patent application number CN01803941.3 discloses that in an inkjet printer, an identification device may be disposed on the printer's main body, and a chip with a storage unit may be disposed on the ink cartridge; and the identification device may determine whether an incorrect ink cartridge is installed in the printer's main body by comparing whether the identification information stored in the storage unit in the chip is consistent with a preset requirement.

In the process of implementing the present disclosure, the inventor found that, in the technical solution of the existing technology, through the manner of adding the chip to the consumable, it may determine whether the chip disposed on the consumable meet a preset requirement after the consumable is installed in the image forming apparatus; however, the existing technology may lack a technical solution that the chip can be matched with a detection module/unit in the main body of the image forming apparatus and whether terminals at the chip side are in a desired contact with pins at the main body side of the image forming apparatus can be detected. Specifically, the chip disposed on the consumable and the detection module/unit in the main body of the image forming apparatus may normally require the terminals at the chip side and the pins at the main body side of the image forming apparatus to transmit communication information; and the terminals at the chip side and the pins at the main body side of the image forming apparatus may normally be in elastic contact. Therefore, the normal communication process may require desired contact between the terminals at the chip side and the pins at the main body side of the image forming apparatus to ensure effective signal transmission between the chip and the image forming apparatus. The long usage time of the image forming apparatus may result in the pins at the main body side of the image forming apparatus to be deformed; the handling process may result in the pins at the main body side of the image forming apparatus to be loose; improper installation may lead to a small contact area between the terminals at the chip side and the pins at the main body side of the image forming apparatus; and the terminal surface at the chip side may be dirty, which may all cause that the terminals at the chip side and the pins at the main body side of the image forming apparatus are in physical contact, but signals cannot be transmitted as expected requirements. This is because when the pins at the main body side of the image forming apparatus and the terminals at the chip side are in a poor contact, the contact resistance between the pins and terminals may increase, thereby increasing the voltage detected by the system-on-chip (SoC) at the side of the image forming apparatus. Normally, for a complementary metal oxide semiconductor (CMOS) circuit, when the input voltage is greater than 0.3 VCC, it is not easy to be identified as a low level, which may result in data distortion. Moreover, if the voltage of the digital input pin of the SoC is between 0.3 VCC and 0.7 VCC, it may result in the power consumption of the SoC to be large and even errors in the internal logic of the SoC, which may cause the crashing risk of the image forming apparatus. Furthermore, in high-speed communication, the product of the contact resistance and the input capacitance of the input terminal (RC time constant) may be excessively large, which may cause the rising and falling edges of the signal to be less steep, result in unreliable communication, and seriously affect the effectiveness of data transmission. Therefore, there is an urgent need to develop a solution for detecting whether the terminals at the chip side and the pins at the main body side of the image forming apparatus are in a poor contact.

BRIEF SUMMARY OF THE DISCLOSURE

The objective of the present disclosure is to provide an electrical parameter detection method, a chip, a consumable, and an image forming apparatus, which may accurately determine whether the terminals at the chip side and the pins at the main body side of the image forming apparatus are in a poor contact.

One aspect of the present disclosure provides an electrical parameter detection method, applied to an image forming apparatus and a chip. The image forming apparatus is detachably installed with a consumable; the consumable is installed with the chip; the image forming apparatus includes an installation detecting pin and an image forming control unit; and the chip includes an installation detecting terminal and a chip control unit. The method includes configuring, by the image forming control unit, the installation detecting pin to be at a high level; controlling, by the chip control unit, a voltage of the installation detecting terminal to be at a low level directly, such that a current loop is formed between the image forming apparatus and the chip; and determining, by the image forming apparatus, whether the image forming apparatus is in a desired contact with the chip according to an electrical parameter of the current loop.

Another aspect of the present disclosure provides a chip, where the chip is installed on a consumable, the consumable is detachably installed on an image forming apparatus, and the image forming apparatus includes an installation detecting pin. The chip includes an installation detecting terminal, configured to be connected with the installation detecting pin of the image forming apparatus; and a chip control unit, configured to directly control a voltage of the installation detecting terminal to be at a low level, such that a current loop is formed between the image forming apparatus and the chip.

Another aspect of the present disclosure provides a consumable, including: a housing; a developer container, which is located in the housing and configured to contain developer; and a chip according to the above-mentioned second aspect.

Another aspect of the present disclosure provides a consumable, including: a photosensitive drum; a charging roller, configured to charge the photosensitive drum; and a chip according to the above-mentioned second aspect.

Another aspect of the present disclosure provides an image forming apparatus, detachably installed with a consumable. The consumable is installed with a chip, the chip includes an installation detecting terminal. The image forming apparatus includes an installation detecting pin, configured to be connected with the installation detecting terminal of the chip; and an image forming control unit, configured to configure the installation detecting pin to be at a high level, such that a voltage of the installation detecting pin is higher than a voltage of the installation detecting terminal, where when the voltage of the installation detecting pin is higher than the voltage of the installation detecting terminal, a current loop is formed between the image forming apparatus and the chip; and the image forming apparatus is further configured to determine whether the image forming apparatus is in a desired contact with the chip according to an electrical parameter of the current loop.

In various embodiments of the present disclosure, the image forming control unit may configure the installation detecting pin to be at a high level, and the chip control unit may control the voltage of the installation detecting terminal to be at a low level; and the installation detecting pin and the installation detecting terminal may have the potential difference, such that the current loop may be formed between the image forming apparatus and the chip. In two cases of desired contact and poor contact between the image forming apparatus and the chip, the values of the electrical parameters may be not equal. Whether the image forming apparatus is in the desired contact with the chip may be accurately determined according to the electrical parameter of the current loop.

BRIEF DESCRIPTION OF THE DRAWINGS

In order to more clearly illustrate the technical solutions of various embodiments of the present disclosure, the drawings that need to be used in various embodiments are briefly described hereinafter. It should be understood that the following drawings only show certain embodiments of the present disclosure, and therefore should not be regarded as scope limitation. For those skilled in the art, other related drawings can be obtained based on such drawings without creative work.

FIG. 8-1 illustrates a connection circuit diagram between a chip and a main body side of an image forming apparatus according to various embodiments of the present disclosure;

FIG. 8-2 illustrates another connection circuit diagram between a chip and a main body side of an image forming apparatus according to various embodiments of the present disclosure;

FIG. 8-3 illustrates another connection circuit diagram between a chip and a main body side of an image forming apparatus according to various embodiments of the present disclosure;

DETAILED DESCRIPTION

Figure 1:
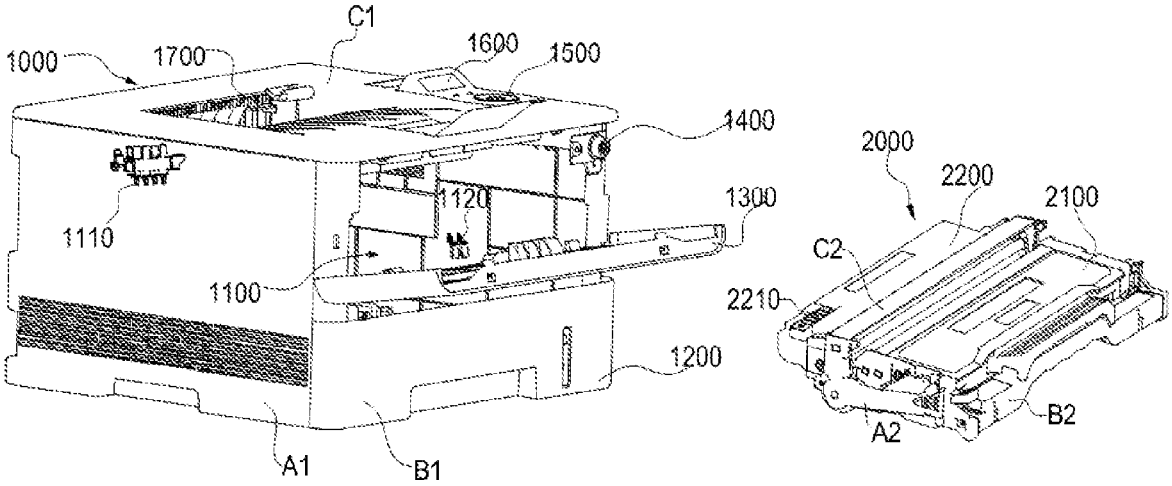
FIG. 1 illustrates a schematic of an image forming apparatus frame and a processing cartridge according to various embodiments of the present disclosure.

In order to more clearly illustrate the objectives, technical solutions, and advantages of various embodiments of the present disclosure, the technical solutions in various embodiments of the present disclosure are described clearly and completely in conjunction with the accompanying drawings in various embodiments of the present disclosure. Obviously, the described embodiments may be a part of various embodiments of the present disclosure, rather than all of various embodiments. Normally, the assemblies (elements) of various embodiments of the present disclosure described and illustrated in the drawings herein may be arranged and designed in various different configurations.

It should be noted that various embodiments of the present disclosure relate to the communication between an image forming apparatus and a chip. Both the main body side of the image forming apparatus and the chip side may include electrical contact parts. When the electrical contact parts at the main body side of the image forming apparatus and the electrical contact parts at the chip side are in a desired contact, data may be stably transmitted between the image forming apparatus and the chip. The electrical contact parts may be a conductive plane, a conductive probe, a conductive coil, and the like.

In order to distinguish the electrical contact parts at the main body side of the image forming apparatus from the electrical contact parts at the chip side, in various embodiments of the present disclosure, the electrical contact parts at the main body side of the image forming apparatus is also referred to as pins at the main body side of the image forming apparatus, and the electrical contact parts at the chip side is referred to as terminals at the chip side.

Furthermore, it should be noted that in various embodiments of the present disclosure, the pins at the main body side of the image forming apparatus may be pins disposed on the main body of the image forming apparatus, or may be pins disposed on transferring/connecting elements, where the transferring/connecting elements may extend from the main body of the image forming apparatus, and be attached to the main body of the image forming apparatus.

As shown in FIG. 1, the following abbreviations may be used for the convenience of description hereinafter. In FIG. 1, A1 is the left side surface of an image forming apparatus, B1 is the front surface of the image forming apparatus, C1 is the upper surface of the image forming apparatus, the opposite to A1 is the right side surface, the opposite to B1 is the back surface, and the opposite to C1 is the lower surface; A2 is the left side surface of a processing cartridge, B2 is the front surface of the processing cartridge, C2 is the upper surface of the processing cartridge, the opposite to A2 is the right side surface, the opposite to B2 is the back surface, and the opposite to C2 is the bottom surface. An image forming apparatus 1000 provided in one embodiment may include: a frame, which is also called the body or main body of the image forming apparatus; a processing cartridge installation part 1100 located in the frame; a paper tray 1200 located below the processing cartridge installation part 1100; a paper transport mechanism (not shown) provided between the processing cartridge installation part 1100 and the paper tray 1200; and a door cover 1300 located on the front surface of the frame and pivotally connected to the frame. When the door cover 1300 is in an open state in FIG. 1, a processing cartridge 2000 may be installed to or removed from the processing cartridge installation part 1100; and when the door cover 1300 rotates along a pivot axis with respect to the back surface to a closed state, the processing cartridge 2000 may be stably installed on the processing cartridge installation part 1100. A first communication part 1110 for being in contact and communication with a first chip disposed on the processing cartridge 2000 and a second communication part 1120 for being in contact and communication with a second chip disposed on the processing cartridge 2000 may also be disposed in the processing cartridge installation part 1100, respectively. In an optional technical solution, the processing cartridge 2000 provided in one embodiment may be a split type, that is, the processing cartridge 2000 may include a developing cartridge 2100 containing developer and a drum assembly 2200 installed with a photosensitive drum. The image forming apparatus 1000 provided in one embodiment may further include a power switch 1400, which is located on the front surface of the frame, near the right side surface and the upper surface, an operation panel 1500, a display panel 1600, and a paper discharge part 1700 located on the upper surface of the frame.

In one embodiment, an aspect of the present disclosure is to detect the reliability status between the chip at the consumable side and the communication part that communicates with the chip at the main body side of the image forming apparatus. The consumables mentioned in one embodiment may be the drum assembly 2200 in the processing cartridge 2000 mentioned below, also be the developing cartridge 2100 in the processing cartridge 2000 mentioned below, and also be the processing cartridge 2000 including the developing cartridge 2100 and the drum assembly 2200. The processing cartridge 2000 may be a split processing cartridge corresponding to FIG. 1 or an integrated processing cartridge. In addition, the consumables mentioned in one embodiment may also be other components, parts, and units in the image forming apparatus that are easily damaged and need to be replaced, such as the paper tray 1200, a fixing assembly, and a toner cartridge. When the paper tray 1200, the fixing assembly, or the toner cartridge is provided with the chip that communicates with the main body of the image forming apparatus, it may also belong to the technical solutions corresponding to the consumables protected by the present disclosure.

Figure 2:
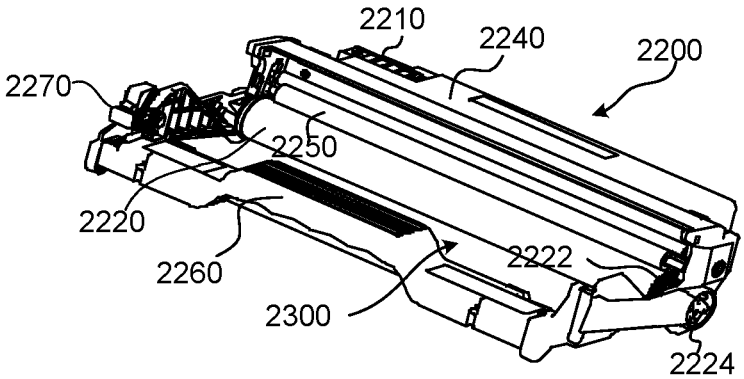
FIG. 2 illustrates a structural schematic of a drum assembly in a processing cartridge according to various embodiments of the present disclosure.
Figure 3:
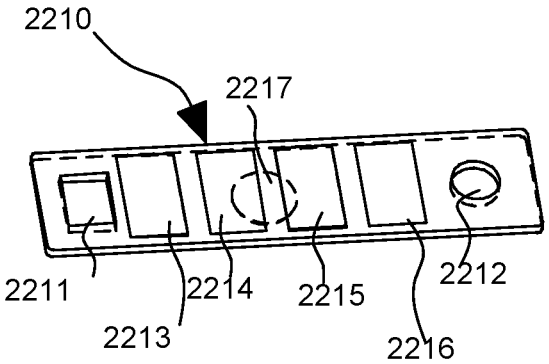
FIG. 3 illustrates a structural schematic of a chip disposed on a drum assembly according to various embodiments of the present disclosure.
Figure 4:
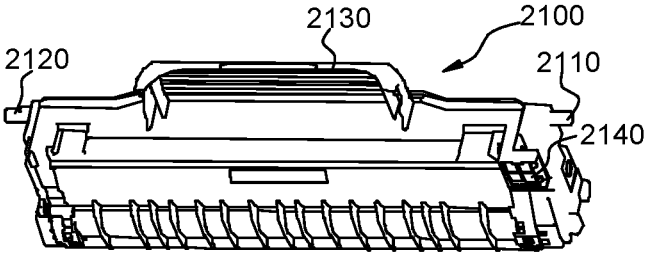
FIG. 4 illustrates a structural schematic of a developing cartridge according to various embodiments of the present disclosure.

As shown in FIGS. 2 and 4, the housing of the drum assembly 2200 (i.e., the part formed by injection molding on an outer side) may be disposed with a developing cartridge installation part 2300 that contains the developing cartridge 2100; and a locking mechanism 2270 for locking the developing cartridge may be disposed at a position on the upper surface of the drum assembly 2200 and adjacent to the left side surface and the front surface. Although FIG. 2 only shows a locking mechanism, those skilled in the art may also optionally dispose a locking mechanism which is same or similar to the locking mechanism 2270 at a position on the upper surface and adjacent to the right side surface and the front surface. The left side surface and the right side surface of the developing cartridge 2100 may be respectively disposed with locking parts 2120 and 2110. A hand-held part 2260 may be disposed at the junction of the front surface and the upper surface of the housing of the drum assembly 2200 to facilitate users to install and remove the processing cartridge 2000. The drum assembly 2200 may be further disposed with a photosensitive drum 2220 and a charging roller 2250 for charging the photosensitive drum 2220. The right end portion of the photosensitive drum 2220 may be disposed with a driving head 2224, which receives the driving force from the image forming apparatus, and a transmission gear 2222, which transmits the power received by the driving head 2224 to a rotating part in the developing cartridge 2100. The drum assembly 2220 may be further disposed with a waste toner container 2240 for containing waste toner; and a first chip 2210 may be disposed at a position on the upper surface of the waste toner container 2240 and adjacent to the rear surface and the left side surface. As shown in FIGS. 2-3, a squared hole 2211 and a rounded hole 2212 may be respectively disposed on the substrate of the first chip 2210; and a squared column and a cylindrical column which are matched with the squared hole and the rounded hole may be respectively disposed on the waste toner container 2240. Through the fitting between the squared hole and the squared column, and between the rounded hole and the cylindrical column, the first chip 2210 may be stably installed on the upper surface of the waste toner container 2240 without moving along the front, back, left and right directions. Along a vertical direction, the cylindrical column and the squared column may be thermally welded or a restricting cantilever may be disposed at the end portion of the squared column, thereby ensuring that the first chip 2210 may not move along the vertical direction.

Figure 6:
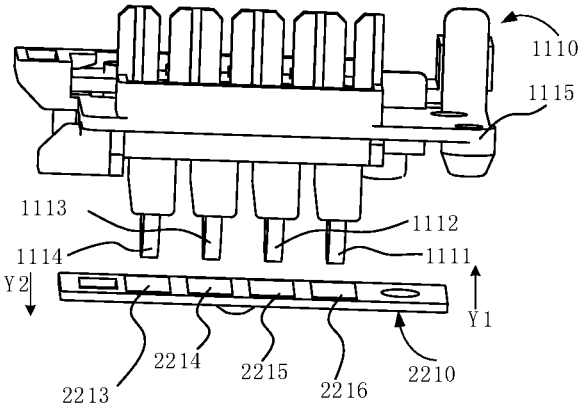
FIG. 6 illustrates a structural schematic of a chip disposed on a drum assembly and terminals in the main body of the image forming apparatus according to various embodiments of the present disclosure.

As shown in FIGS. 2, 3, and 6, the upper surface of the substrate of the first chip 2210 may be respectively disposed with four side-by-side terminals: a power terminal 2213 which is the closest to the left side of the drum assembly 2200, a data signal terminal 2214 which is immediately next to the power terminal 2213, a ground terminal 2215 which is immediately next to the data signal terminal 2214, and a clock signal terminal 2216 on the rightmost side. The power terminal is also referred to as VCC, and the ground terminal is also referred to as GND. A microcontroller may be disposed on the lower surface of the first chip 2210, and the microcontroller may be integrated in a package element 2217. The package element 2217 may adopt a soft package manner or a hard package manner. The package element 2217 may be located at the position between projections of the data signal terminal 2214 and the ground terminal 2215 along the left and right direction of the drum assembly (referred to as the length direction of the first chip hereinafter), that is, the middle position along the length direction of the bottom surface of the substrate. As shown in FIGS. 1 and 6, the first communication part 1110 in the main body of the image forming apparatus may be arranged on an LSU (laser scanning unit, configured to expose the photosensitive drum, not shown in FIGS. 1 and 6) of the image forming apparatus. The first communication part 1110 may also be disposed with a first power pin 1114 at the main body side, a first data signal pin 1113 at the main body side, a first ground pin 1112 at the main body side, a first clock signal pin 1111 at the main body side, which may communicate with the power terminal 2213, the data signal terminal 2214, the ground terminal 2215, and the clock signal terminal 2216 disposed on the first chip. These pins may be fixed on an injection molded part 1115 in the LSU, and may also be connected to a main controller in the image forming apparatus through wires.

Figure 5:
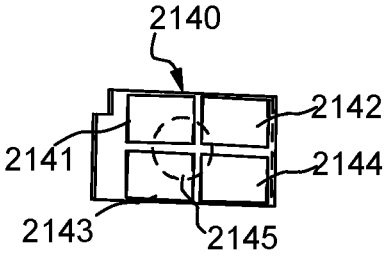
FIG. 5 illustrates a structural schematic of a chip disposed on a developing cartridge according to various embodiments of the present disclosure.

As shown in FIGS. 4-5, the front surface of the developing cartridge 2100 may also be disposed with a hand-held part 2130, which is convenient for users to install and remove the developing cartridge 2100. Furthermore, a second chip 2140 may further be disposed at a position on the lower surface and adjacent to the front surface and the right side surface of the developing cartridge 2100. One surface of the substrate of the second chip 2140 may also be disposed with four terminals: a data signal terminal 2141 and a clock signal terminal 2142 which are in a row adjacent to the front surface; and a power terminal 2143 and a ground terminal 2144 which are located in the second row. Another surface of the substrate of the second chip 2140 opposite to the terminals may be disposed with a package element 2145; and the package element 2145 may be located at the central position of the substrate, as shown in FIG. 5. Along the direction perpendicular to the contacting point surface, the projection of the package element 2145 may overlap the four terminals 2141, 2142, 2143 and 2144, respectively.

The first and second in one embodiment are only for facilitating those skilled in the art to clearly understand the technical solutions in one embodiment, but not for limiting the present disclosure. Those skilled in the art may also swap all "first" and "second" involved the first chip and the second chip, and in the first communication part and the second communication part; and may also use more numbers, such as "third", "fourth" and the like, for limitation. Furthermore, those skilled in the art may dispose only the first chip or only the second chip in the processing cartridge according to actual product requirements.

Figure 7:
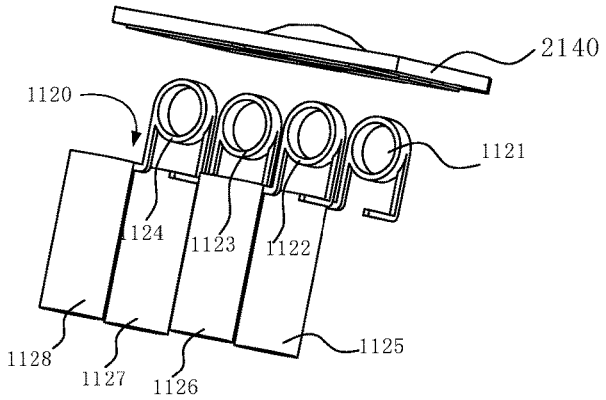
FIG. 7 illustrates a structural schematic of a chip disposed on a developing cartridge and terminals in the main body of the image forming apparatus according to various embodiments of the present disclosure.

As shown in FIGS. 1 and 7, the second communication part 1120 in the main body of the image forming apparatus may be located on a paper transport unit of the image forming apparatus; and the second communication part 1120 may also be respectively disposed with a second power pin 1123 at the main body side, a second data signal pin 1121 at the main body side, a second ground pin 1124 at the main body side, a second clock signal pin 1122 at the main body side, which may communicate with the power terminal 2143, the data signal terminal 2141, the ground terminal 2144, and the clock signal terminal 2142 disposed on the second chip 2140. In addition, the signal pins at the main body side may be a part of the circular ring springs, and such circular ring springs may be connected to cylindrical columns 1127, 1125, 1128, and 1126 respectively. The cylindrical columns 1127, 1125, 1128, and 1126 may also be made of conductive springs, respectively. The conductive springs may be then connected to the main controller inside the image forming apparatus through wires, thereby completing the communication between the main controller of the image forming apparatus and the second chip 2140.

The long usage time of the image forming apparatus may result in the pins at the main body side of the image forming apparatus to be deformed; the handling process may result in the pins at the main body side of the image forming apparatus to be loose; improper installation may lead to a small contact area between the terminals at the chip side and the pins at the main body side of the image forming apparatus; and the terminal surface at the chip side may be dirty, which may all cause that the terminals at the chip side and the pins at the main body side of the image forming apparatus are in physical contact, but signals cannot be transmitted as expected requirements.

As shown in FIGS. 1, 6, and 7, when the pins at the side of the first communication part 1110 are connected to the terminals at the side of the first chip 2210 or when the pins at the side of the second communication part 1120 are connected to the terminals at the side of the second chip 2140, the processing cartridge 2000 may not be installed in a specified position in the processing cartridge installation part 1100, such that the terminals at the chip side may have poor contact with the pins at the main body side of the image forming apparatus. For example, the first chip 2210 may be tilted along the Y1 and Y2 directions in FIG. 6, the pin 1111 at the main body side of the image forming apparatus may be in a desired contact with the clock signal terminal 2216 at the chip side, such that the signal transmission between the pin 1111 at the main body side of the image forming apparatus and the clock signal terminal 2216 at the chip side may be relatively stable; however, the pin 1114 at the main body side of the image forming apparatus may be in a poor contact with the power terminal 2213 at the chip side, which may cause unreliable signal transmission between the pin 1114 at the main body side of the image forming apparatus and the power terminal 2213 at the chip side and also cause the main controller in the main body of the image forming apparatus not to receive the signal from the chip at the side of the processing cartridge.

In an optional technical solution of one embodiment, when the processing cartridge 2000 is installed to a specified position in the processing cartridge installation part 1100 (in such case, the contact between the pins at the main body side of the image forming apparatus and the terminals at the chip side is desired), the contact area between the pins at the main body side of the image forming apparatus and the terminals at the chip side is a first contact area; and when the processing cartridge 2000 is not installed to a specified position in the processing cartridge installation part 1100, the contact area between the pins at the main body side of the image forming apparatus and the terminals at the chip side is a second contact area. Normally, the second contact area may be less than the first contact area, and a decrease in the contact area may increase the contact resistance, such that the voltage detected by the SoC at the image forming apparatus side may be higher. Normally, for CMOS circuits, when the input voltage is greater than 0.3 VCC, it is not easy to be identified as a low level, which may result in data distortion. Moreover, if the voltage of the digital input pin of the SoC is a middle level between 0.3 VCC and 0.7 VCC, it may result in the power consumption of the SoC to be larger and even errors in the internal logic of the SoC, which may cause the crashing risk of the image forming apparatus. Furthermore, in high-speed communication, the product of the contact resistance and the input capacitance of the input terminal (RC time constant) may be excessively large, which may cause the rising and falling edges of the signal to be less steep, result in unreliable communication, and seriously affect the effectiveness of data transmission; and as a result, the main controller of the image forming apparatus may not correctly identify the chip.

Based on the above-mentioned reasons, in the technical solutions in the existing technology, if the above-mentioned case occurs, it is highly likely to directly determine that the chip in the processing cartridge is not normal, and the user may be prompted to replace the processing cartridge. However, the real reason may be that the chip in the processing cartridge itself is desired, but the pins at the main body side of the image forming apparatus may in a poor contact with the terminals at the chip side. The technical solutions provided by various embodiments of the present disclosure may accurately detect the case that the poor contact is between the pins at the main body side of the image forming apparatus and the terminals at the chip side, and the specific detection process may be described in detail hereinafter.

Figures 1, 8:
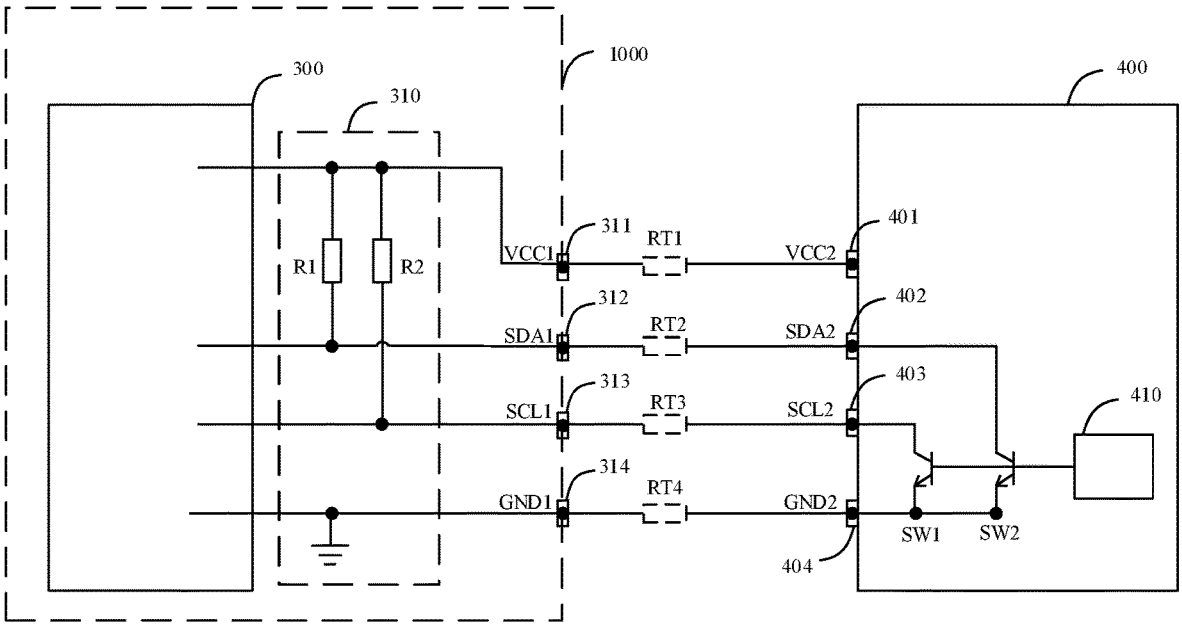
Figures 2, 8:
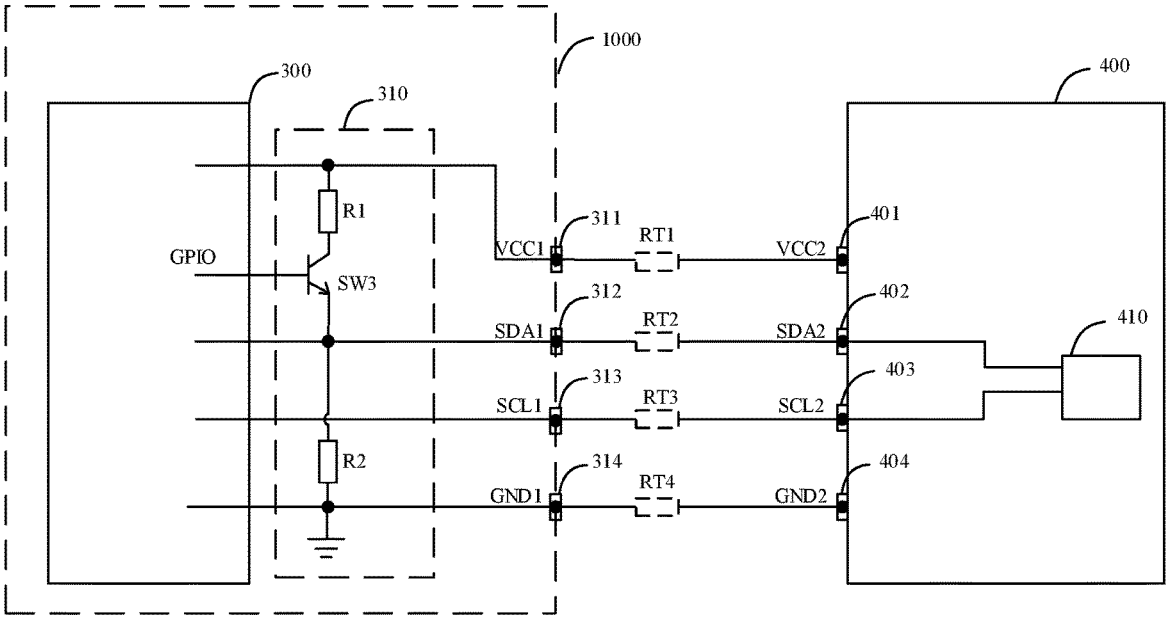
Figures 3, 8:
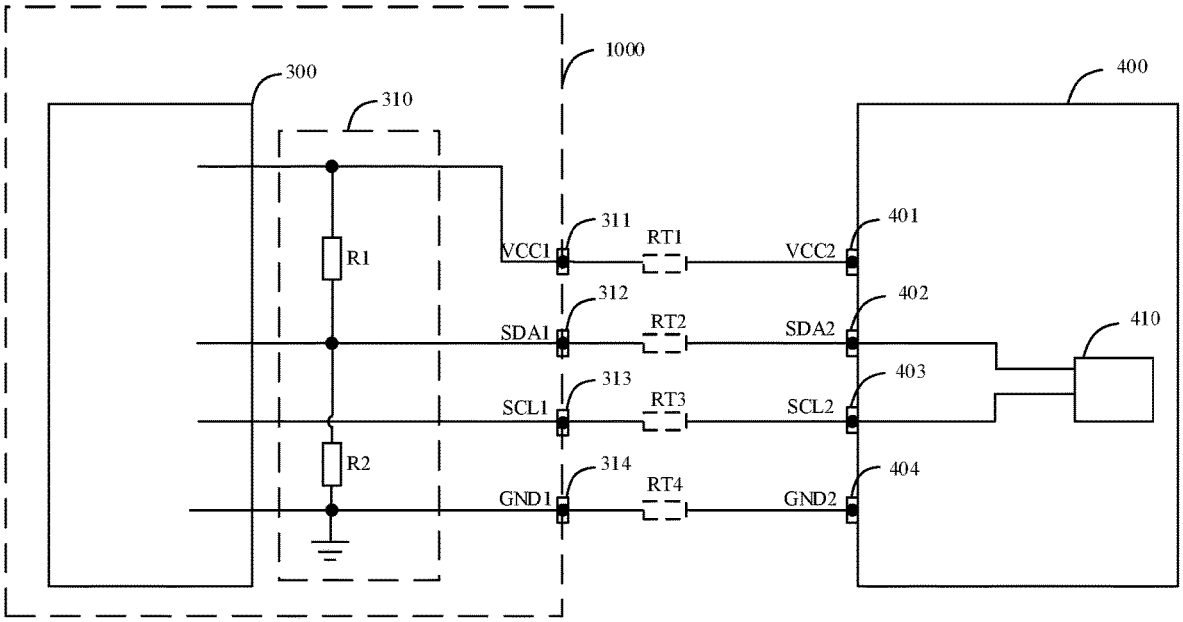

Referring to FIG. 8-1, an image forming apparatus 1000 and the chip may be connected through an I2C (inter-integrated circuit) bus. The image forming apparatus 1000 may include an image forming control unit 300 and installation detecting pins (marked as SDA1 and SCL1 in FIG. 8-1 in one embodiment). The installation detecting pins may be configured to be electrically connected with the installation detecting terminals of the chip. Specifically, the installation detecting pins may be electrically connected to the installation detecting terminals of the chip at the consumable side. The image forming control unit may be configured to configure the installation detecting pin to a high level, such that the voltage of the installation detecting pin may be higher than the voltage of the installation detecting terminal, where when the voltage of the installation detecting pin is higher than the voltage of the installation detecting terminal, a current loop may be formed between the image forming apparatus and the chip, and the image forming apparatus may be further configured to determine whether the image forming apparatus and the chip are in a desired contact according to electrical parameters of the current loop.

Referring to FIG. 8-1, the image forming apparatus 1000 may further include an impedance circuit 310.

In various embodiments of the present disclosure, the impedance circuit 310 may include impedance elements. The impedance elements may be a resistor, a capacitor, an inductance and the like, that is, the impedance circuit 310 may include at least one of a resistor, a capacitor, and an inductance. The impedance circuit 310 may also include a switch element, that is, an element functioning as a switch.

Referring to FIG. 8-1, the pin 311 at the main body side of the image forming apparatus may be in contact with the terminal 401 at the chip side, and the contact resistance between the pin 311 and the terminal 401 may be equivalent to RT1; the pin 312 at the main body side of the image forming apparatus may be in contact with the terminal 402 at the chip side, and the contact resistance between the pin 312 and the terminal 402 may be equivalent to RT2; the pin 313 at the main body side of the image forming apparatus may be in contact with the terminal 403 at the chip side, and the contact resistance between the pin 313 and the terminal 403 may be equivalent to RT3; and the pin 314 at the main body side of the image forming apparatus may be in contact with the terminal 404 at the chip side, and the contact resistance between the pin 314 and the terminal 404 may be equivalent to RT4.

The chip 400 may include installation detecting terminals (referred to as SDA2 and SCL2 in one embodiment) and a control unit 410. The installation detecting terminal may be configured for electrical connection with the installation detecting pin of the image forming apparatus. The control unit 410 may be disposed with a storage unit which stores parameters related to the performance of replaceable elements (such as lifetime information, a number of use times, a production date, a remaining amount of consumables in the replaceable element and the like) and a communication element which communicates with the image forming apparatus; and the communication element may complete data exchange with the image forming apparatus through the connection line of SCL (the clock signal line of the I2C bus) and SDA (data signal line of the I2C bus). The chip 400 in one embodiment may be the first chip 2210 and/or the second chip 2140 mentioned above.

The control unit 410 may be configured to configure the installation detecting terminal to a low level, so that a current loop may be formed between the installation detecting terminal and the image forming apparatus, where the electrical parameters of the current loop may be used to determine whether the image forming apparatus and the chip 400 are in a poor contact.

In one embodiment, the configuration information of the corresponding installation detecting terminal may be directly modified through the control unit 410, such that the installation detecting terminal may directly output a low-level signal, thereby configuring the installation detecting terminal to be at a low level.

Those skilled in the art should understand that the present disclosure may not limit the manner in which the installation detecting terminal is configured to be at a low level.

In order to form the current loop between the chip and the image forming apparatus, it is also necessary to configure the installation detecting pin at the side of the image forming apparatus to be at a high level.

Various manners may be used to configure the installation detecting pin at the side of the image forming apparatus to be at a high level. For example:

the installation detecting pin at the side of the image forming apparatus may be directly or indirectly connected to the pin with a high level at the side of the image forming apparatus, such as the power supply pin of the printer main control SoC, or the signal pin configured as a high level, such that the installation detecting pin at the side of the image forming apparatus may be configured to be at a high level. The above-mentioned indirect connection may be a connection through elements such as impedance elements, switching elements and the like. The indirect connection circuits may not be limited, as long as the installation detecting pin is configured to be at a high level.

Those skilled in the art should understand that various embodiments of the present disclosure may not limit the manner of how the installation detecting pin is configured to be at a high level.

Referring to FIG. 8-2, the difference between the technical solution provided in one embodiment and the solution shown in FIG. 8-1 may be that in one embodiment, the impedance circuit 310 may include a first resistor R1, a third switch element SW3, and a second resistor R2, where the third switch element SW3 may include a control terminal, a first electrode, and a second electrode. One end of the first resistor R1 may be electrically connected to a voltage pin, and the other end of the first resistor R1 may be electrically connected to the first electrode. The one end of the second resistor R2 may be electrically connected to the second electrode, and the other end of the second resistor may be grounded. The control terminal may be electrically connected to the image forming control unit, and the installation detecting pins may be electrically connected between the second electrode and the second resistor R2, where the installation detecting pins may be SDA1 and/or SCL1. The voltage of the pin SDA1 is VCC1*R2/(R1+R2), the control unit 410 of the chip may configure the terminal SDA2 to be at a low level, and a potential difference may be between the pin SDA1 at the side of the image forming apparatus and the terminal SDA2 at the chip side, such that a current loop may be formed between the chip and the image forming apparatus. The image forming apparatus may control SCL1 to output a high level, the control unit 410 of the chip may configure the terminal SCL2 to be at a low level, and a potential difference may be between the pin SCL1 at the side of the image forming apparatus and the terminal SCL2 at the chip side, such that a current loop may be formed between the chip and the image forming apparatus.

The third switch element SW3 may be an electrical element having two states of conduction and cutoff, such as a triode, a MOS transistor, a single-pole single-throw or a multi-throw switch, and/or the like. In one embodiment, the image forming control unit may be provided with a general purpose input output port (GPIO), and the control electrode may be electrically connected to the GPIO port. The conduction and cutoff of the third switch element SW3 may be controlled through the GPIO port.

The installation detecting terminals may be SDA2 and/or SCL2.

Referring to FIG. 8-2, the pin 311 at the main body side of the image forming apparatus may be in contact with the terminal 401 at the chip side, and the contact resistance between the pin 311 and the terminal 401 may be equivalent to RT1; the pin 312 at the main body side of the image forming apparatus may be in contact with the terminal 402 at the chip side, and the contact resistance between the pin 312 and the terminal 402 may be equivalent to RT2; the pin 313 at the main body side of the image forming apparatus may be in contact with the terminal 403 at the chip side, and the contact resistance between the pin 313 and the terminal 403 may be equivalent to RT3; and the pin 314 at the main body side of the image forming apparatus may be in contact with the terminal 404 at the chip side, and the contact resistance between the pin 314 and the terminal 404 may be equivalent to RT4.

The image forming control unit may also be configured to control the third switch element SW3 to be in conduction, and configure the installation detecting pin to be at a high level when the installation detecting terminal is configured to be at a low level, such that a current loop may be formed between the image forming apparatus and the chip.

In one embodiment, the control unit 410 may configure the installation detecting terminal to be at a low level according to the configuration signal transmitted by the image forming apparatus.

As shown in FIG. 8-3, the third switch element SW3 in the technical solution provided by one embodiment may also be omitted.

In one embodiment, the impedance circuit 310 may include the first resistor R1 and the second resistor R2. The first resistor and the second resistor may be connected in series between the voltage pin and the ground. The installation detecting pin may be electrically connected between the first resistor and the second resistor.

Referring to FIG. 8-3, in one embodiment of the present disclosure, SDA1 may be used as the installation detecting pin, and SDA2 may be used as the installation detecting terminal; the pin 311 at the main body side of the image forming apparatus may be in contact with the terminal 401 at the chip side, and the contact resistance between the pin 311 and the terminal 401 may be equivalent to RT1; the pin 312 at the main body side of the image forming apparatus may be in contact with the terminal 402 at the chip side, and the contact resistance between the pin 312 and the terminal 402 may be equivalent to RT2; the pin 313 at the main body side of the image forming apparatus may be in contact with the terminal 403 at the chip side, and the contact resistance between the pin 313 and the terminal 403 may be equivalent to RT3; and the pin 314 at the main body side of the image forming apparatus may be in contact with the terminal 404 at the chip side, and the contact resistance between the pin 314 and the terminal 404 may be equivalent to RT4.

The contact between the pin at the side of the image forming apparatus and the terminal at the chip side may normally have three cases.

At the first case, the pin at the side of the image forming apparatus may be completely disconnected from the terminal at the chip side; and in such case, the image forming apparatus and the chip may not communicate completely.

At second case, the pin at the side of the image forming apparatus may be in a desired contact with the terminal at the chip side; and in such case, the image forming apparatus and the chip may communicate with each other stably. That is, when the contact between the chip and the image forming apparatus is desired, the communication state between the chip and the image forming apparatus is stable. That is to say, the data transmission between the chip and the image forming apparatus may not experience data transmission failures such as data distortion, data transmission interruption and the like.

At the third case, the pin at the side of the image forming apparatus may be in contact with the terminal at the chip side but a poor contact problem may occur. In such case, the image forming apparatus and the chip may communicate with each other, but the communication state may not be sufficiently stable. That is to say, the data transmission between the chip and the image forming apparatus may experience data transmission failures such as data distortion, data transmission interruption and the like.

If a current loop is formed between the image forming apparatus and the chip, it may indicate that the image forming apparatus is in contact with the chip. As for whether the contact is desired, it needs to be determined according to the electrical parameters of the current loop.

At the case of desired contact, the contact resistance may be relatively small; and at the case of poor contact, the contact resistance may be relatively large.

After the installation detecting terminal is configured to be at a low level and the installation detecting pin is connected to be at a high level, and when the installation detecting terminal is in contact with the installation detecting pin, a current loop may be formed between the chip and the image forming apparatus.

For example, as shown in FIG. 8-1, the image forming apparatus may include a voltage pin VCC1, the chip 400 may include a voltage terminal VCC2, and the voltage pin VCC1 may be connected to the voltage terminal VCC2. When the installation detecting terminal is configured to be at a ground level GND, the installation detecting pin SDA1 may be connected to the voltage pin VCC1 through the first pull-up resistor R1, and the installation detecting pin SCL1 may be connected to the voltage pin VCC1 through the second pull-up resistor R2.

After a current loop is formed between the chip and the image forming apparatus, the image forming apparatus may obtain the electrical parameters in the above-mentioned current loop to determine whether the image forming apparatus and the chip are in a desired contact. Specifically, when the current loop is formed between the chip and the image forming apparatus, the terminal of the chip and the pin of the image forming apparatus may have two cases including desired contact or poor contact; and different contact resistance values may be formed between the terminal of the chip and the pin of the image forming apparatus, and the electrical parameters in the above-mentioned current loop may also be different. Therefore, it can be determined whether the terminal of the chip and the pin of the image forming apparatus are in a desired contact according to the values of the electrical parameters in the current loop.

The chip 400 may communicate with the image forming apparatus through I2C. Therefore, a power signal terminal, a data signal terminal, a clock signal terminal, and a ground signal terminal may be disposed at the side of the chip 400; and correspondingly, a power signal pin, a data signal pin, a clock signal pin, and a ground signal pin may be disposed at the side of the image forming apparatus. In order to perform electrical parameter detection between the chip 400 and the image forming apparatus, the data signal terminal at the side of the chip 400 may be selected as the installation detecting terminal, or the clock signal terminal may be selected as the installation detecting terminal, or both the data signal terminal and the clock signal terminal may be used as the installation detecting terminals; correspondingly, the data signal pin at the side of the image forming apparatus may be selected as the installation detecting pin, or the clock signal pin may be selected as the installation detecting pin, or both the data signal pin and the clock signal pin may be used as the installation detecting pins. Normally, the installation detecting pins at the main body side of the image forming apparatus and the installation detecting terminals at the chip side may be disposed in pairs.

Optionally, after the image forming apparatus determines that the image forming apparatus and the chip are in a desired contact according to the electrical parameters of the current loop, the image forming apparatus may read information stored in the chip, and/or the image forming apparatus may write information to the chip.

If the installation detecting terminal at the side of the chip 400 and the installation detecting pin at the main body side of the image forming apparatus are in a poor contact, the communication between the chip 400 and the image forming apparatus may be unstable, and the data transmission failures such as data distortion, data interruption and the like may occur.

If it is determined that, according to the measured electrical parameters, the installation detecting terminal at the side of the chip 400 and the installation detecting pin at the main body side of the image forming apparatus are in a poor contact, the user may be directly prompted.

The chip 400 may also be configured to receive configuration signal transmitted by the image forming apparatus, and control the installation detecting terminal to be configured to be at a low level according to the configuration signal.

The configuration signal may include a power-on signal and a control instruction.

The power-on signal may be a voltage driving signal transmitted by the image forming control unit 300 to the chip 400. When the configuration signal includes the power-on signal, the chip 400 may receive the power-on signal transmitted from the image forming apparatus. The power-on signal outputted by the image forming control unit 300 and received by the chip 400 may indicate that the chip 400 may receive power supply from the image forming apparatus. The control unit 410 may further be configured to configure the installation detecting terminal to be at a low level according to the power-on signal. It should be understood that the image forming apparatus and the chip 400 may agree that after the chip 400 is powered on (the chip 400 is reset), the chip may be triggered to output a detection signal, that is, the control installation detecting terminal may be configured as a low level signal.

Specifically, in one embodiment, the image forming control unit may be further configured to transmit the power-on signal to the chip 400 through the voltage pin VCC1, thereby controlling the installation detecting terminal of the chip 400 to be configured to be at a low level. The chip 400 may be electrically connected to the image forming apparatus through the voltage terminal VCC2 to receive the power-on signal transmitted by the image forming apparatus, and the control unit 410 may configure the installation detecting terminal to be at a low level according to the power-on signal. It should be understood that at this point, the image forming apparatus and the chip 400 may agree that the chip 400 may be triggered after the chip 400 is powered on (the chip 400 is reset). Since the power supply of the chip 400 is implemented through controlling the on and off of the output of the VCC1 by the image forming apparatus, the image forming apparatus may trigger the chip 400 to output the detection signal by controlling the VCC1.

The control instruction may be a preset instruction transmitted by the image forming apparatus that characterizes installation detection. When the configuration signal includes the control instruction, the installation detecting terminal may be further configured to receive the control instruction transmitted by the image forming apparatus. The control unit 410 may further be configured to configure the installation detecting terminal to be at a low level according to the control instruction. For example, the above-mentioned preset instruction may be 0xAA55AA55, and when the chip 400 receives the above-mentioned instruction, the chip 400 may be triggered to output a detection signal.

Furthermore, the control unit 410 may also be configured to configure the installation detecting terminal to be at a low level according to a user event signal triggered by a user. Specifically, according to the user's operation on the user interface of the image forming apparatus, the image forming apparatus may be triggered to transmit a specific signal to the chip 400 to trigger the chip 400. That is, the control unit 410 of the chip 400 may output a level signal, so that the installation detecting terminal may be configured to be at a low level.

Furthermore, the above-mentioned configuration signal may also be a synchronization signal transmitted by the image forming control unit 300 to the chip 400, where the synchronization signal may be specifically a rising or falling edge generated by the image forming control unit 300 on a signal line (a clock signal line or data signal line); when the configuration signal includes the synchronization signal, the installation detecting terminal may be further configured to receive the synchronization signal transmitted from the image forming apparatus. The control unit 410 may be further configured to configure the installation detecting terminal to be at a low level according to the synchronization signal transmitted by the image forming apparatus.

It should be understood that the image forming apparatus and the chip 400 may also agree that the image forming apparatus and the chip 400 may perform data communication; when the chip 400 receives specific data, for example, when the chip 400 receives a control instruction, the chip may output a detection signal. Therefore, the image forming apparatus may trigger the chip 400 to output the detection signal when the power supply of the chip 400 is uninterrupted, such that the installation detecting terminal may be configured to be at a low level.

In one embodiment of the present disclosure, the chip 400 may be disposed with a first switch element, and the control unit 410 may also be configured to be connected with the first switch element. By controlling the conduction of the first switch element, the installation detecting terminal may be configured to be at a low level, that is, the control unit 410 may output a level signal which enables the first switch element to be in a conduction or cutoff state. Therefore, the installation detecting terminal connected to the first switch element may be configured to be at a low level. The first switch element may be selected from electrical elements which have two states of conduction and cutoff, including a triode, a MOS transistor, a single-pole single-throw or single-pole multi-throw switch, and the like.

For example, as shown in FIG. 8-1, two switch elements which are a first switch element SW1 and a second switch element SW2 respectively may be included, where the first switch element SW1 may be connected between the installation detecting terminal SCL2 and the ground terminal GND2 and may be connected to the control unit 410, and the control unit 410 may control the first switch element SW1 to be in conduction and cutoff; and the second switch element SW2 may be connected between the installation detecting terminal SDA2 and the ground terminal GND2 and may be connected to the control unit 410, and the control unit 410 may control the second switch element SW2 to be in conduction and cutoff.

It should be understood that only one of the first switch element SW1 and the second switch element SW2 above-mentioned may also be selected.

The control unit 410 may be further configured to output a pulse signal, which is the detection signal outputted by the chip 400; and the pulse signal may be outputted periodically. For the convenience of description, it is assumed that the duration of the period is T, and the duration T of the period may be divided into the first half period and the second half period. It should be noted that the first half of the period and the second half of the period may be used to distinguish different time durations in a same period, which may have no relationship with the duration. The duration of the first half period may be equal or unequal to the duration of the second half period.

The electrical parameter detection between the chip and the image forming apparatus is performed in the first half of each period, and the electrical parameter detection between the chip and the image forming apparatus is not performed in the second half of each period. Therefore, in the second half of each period, the chip and the image forming apparatus may also exchange other information, which may effectively avoid the problem of low communication efficiency caused by the complete interruption of other information exchange during electrical parameter detection.

Figure 9:
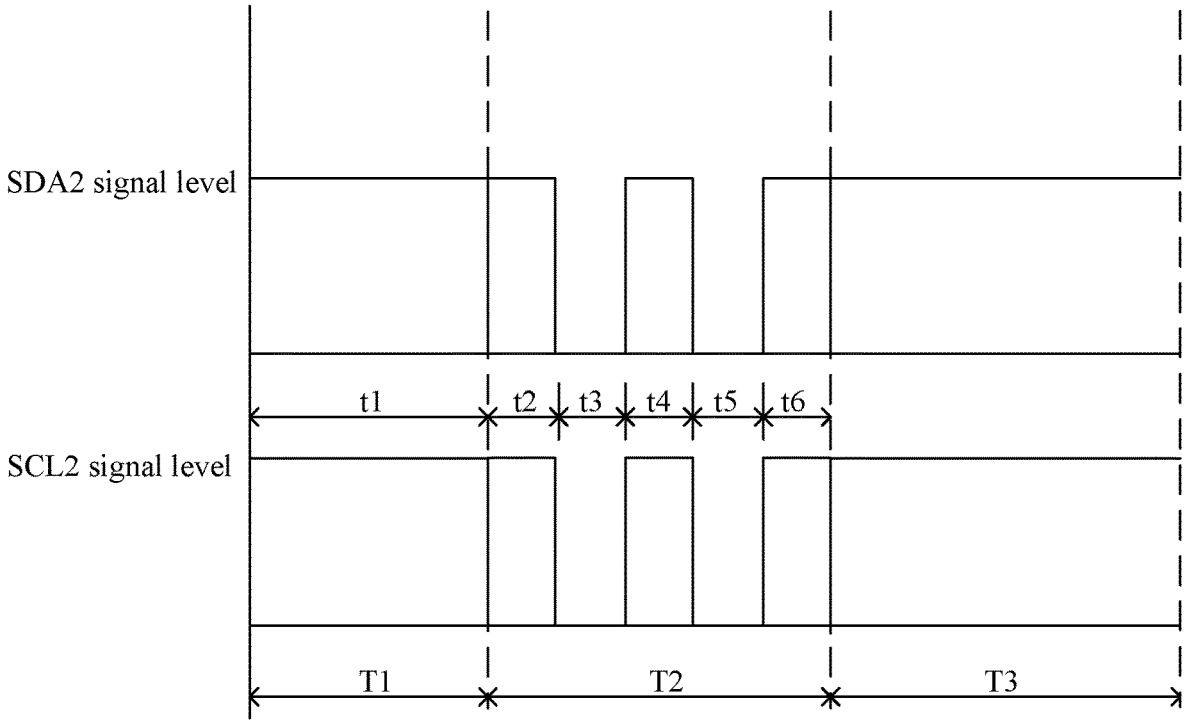
FIG. 9 illustrates a schematic of an electrical parameter detection process of a current loop between a chip and an image forming apparatus according to various embodiments of the present disclosure.

Specifically, as shown in FIG. 9, after the electrical parameter detection between the terminal at the chip side and the pin at the side of the image forming apparatus is triggered, the time duration T1 may be the preparation period, and the time duration T2 may be the detection phase of the electrical parameter detection, and the time duration T3 may be the recovery period after the electrical parameter detection, where the time duration T2 may correspond to multiple pulse signals. Specifically, time duration t1 may correspond to the time duration T1, time durations t2 and t3 may jointly correspond to one pulse signal, and time durations t2, t3, t4, t5, and t6 may together correspond to time duration T2. In the first half of the period, for example, in the time duration t2, the control unit 410 may output a pulse signal with a voltage higher than a first preset threshold, thereby making the voltage of the base of the first switch element SW1 and the voltage of the base of the second switch element SW2 both be higher than the power-on voltage. Therefore, the first switch element SW1 and the second switch element SW2 may both be in a saturated conduction state, and the image forming apparatus and the chip may form two current loops which both can perform the electrical parameter detection between the chip and the image forming apparatus. In the second half of the period, for example, in the time duration t3, the control unit 410 may output a pulse signal with a voltage lower than a second preset threshold, thereby making the voltage of the base of the first switch element SW1 and the voltage of the base of the second switch element SW2 both be lower than the power-on the voltage. Therefore, the first switch element SW1 and the second switch element SW2 may both be in a cutoff state, and no electrical parameter detection may be performed at this point. The first preset threshold may be greater than or equal to the second preset threshold. Furthermore, it is possible to detect only the electrical parameter of one pin at the side of the image forming apparatus. At this point, the circuit may be modified, as long as one current loop can be formed.

As shown in FIG. 9, the number of pulse signals outputted at the chip side may be greater than or equal to 2, that is, multiple electrical parameter detections may need to be performed, and the multiple detection results may be averaged. It may determine whether the installation detecting pin and the installation detecting terminal are in a desired contact based on the averaged value, which may effectively avoid the problem of relatively large detection result error caused by only performing the electrical parameter detection once.

Furthermore, in order to ensure the detection accuracy of whether the installation detecting pin and the installation detecting terminal are in a desired contact, it is also possible to perform multiple electrical parameter detections within the time duration t2. That is, when a current loop is formed between the image forming apparatus and the chip, multiple electrical parameter detections may be performed, and it may be determined whether the installation detecting pin and the installation detecting terminal are in a desired contact according to the detection results of the multiple electrical parameters.

Various embodiments of the present disclosure also provide a consumable, including a housing, a developer container, and the above-mentioned chip. The developer container, located in the housing, may be configured to contain the developer.

As an optional implementation manner, the consumable may further include a developer transport element. The developer transport element may be configured to transport the developer.

As an optional implementation manner, the consumable may further include a photosensitive drum and a charging roller. The charging roller may be configured to charge the photosensitive drum.

Various embodiments of the present disclosure also provide a consumable, including a photosensitive drum, a charging roller, and the above-mentioned chip. The charging roller may be configured to charge the photosensitive drum.

Various embodiments of the present disclosure also provide an image forming apparatus, which may include the above-mentioned consumables. Various embodiment also provides an electrical parameter detection method, which may be applied to the above-mentioned image forming apparatus, where the image forming apparatus may be detachably installed with the consumable, the consumable may be installed with the chip, the image forming apparatus may include installation detecting pins, and the chip may include installation detecting terminals. The image forming apparatus and the chip may be connected through the I2C (inter-integrated circuit) bus.

Figure 10:
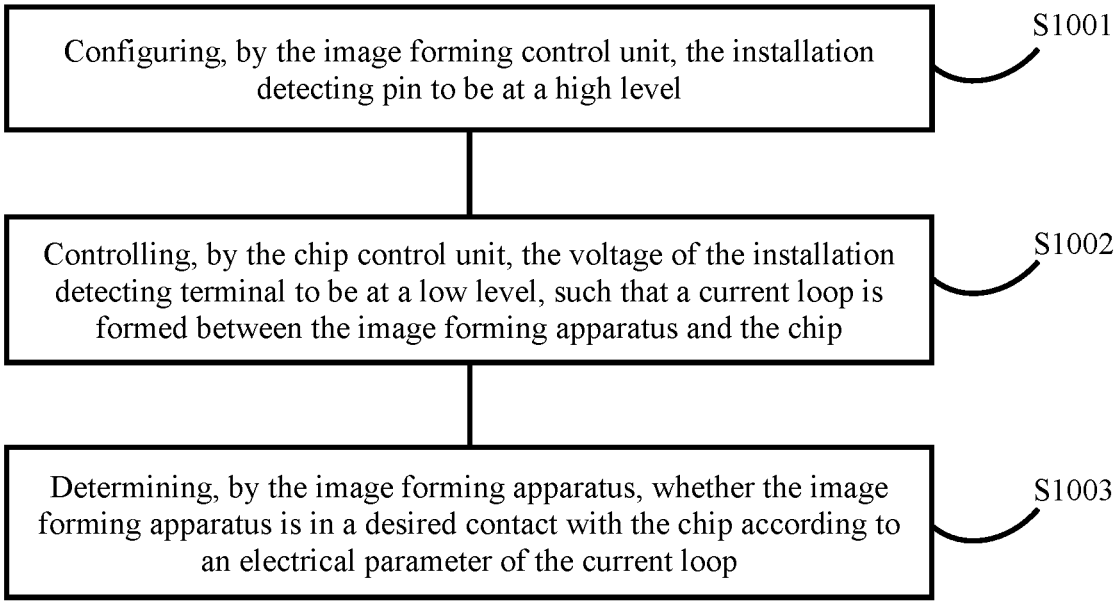
FIG. 10 illustrates a flow chart of an electrical parameter detection method of a current loop between a chip and an image forming apparatus according to various embodiments of the present disclosure.

Referring to FIG. 10, the electrical parameter detection method provided by various embodiments of the present disclosure may include:

at step S1001, the image forming control unit may configure the installation detecting pin to be at a high level;

at step S1002, the chip control unit may control the voltage of the installation detecting terminal to be at a low level, such that a current loop may be formed between the image forming apparatus and the chip; and at step S1003, the image forming apparatus may determine whether the image forming apparatus and the chip are in a desired contact according to the electrical parameters of the current loop.

In various embodiment of the present disclosure, it is determined whether the image forming apparatus and the chip are in the desired contact, that is, it is determined whether the pin at the main body side of the image forming apparatus and the terminal at the chip side are in the desired contact.

Various manners may be used to configure the installation detecting pin at the side of the image forming apparatus to be at a high level. For example:

the installation detecting pin at the side of the image forming apparatus may be directly or indirectly connected to the pin with a high level at the side of the image forming apparatus, such as the power supply pin of the printer main control SoC, or the signal pin configured as a high level, such that the installation detecting pin at the side of the image forming apparatus may be configured to be at a high level. The above-mentioned indirect connection may be a connection through elements such as impedance elements, switching elements and the like. The indirect connection circuits may not be limited, as long as the installation detecting pin is configured to be at a high level.

Those skilled in the art should understand that various embodiments of the present disclosure may not limit the manner of how the installation detecting pin is configured to be at a high level.

The chip control unit may control the voltage of the installation detecting terminal to be at a low level, which specifically includes the following implementation manners.

One implementation manner may be the direct modification of the configuration information of the installation detecting terminal through the control unit 410, such that the installation detecting terminal may directly output a low-level signal, thereby configuring the installation detecting terminal to be at a low level.

In another implementation manner, the control unit 410, after receiving the configuration signal transmitted by the image forming apparatus, may be triggered to output the detection signal, such that the installation detecting terminal may be configured to be at a low level. In various embodiments of the present disclosure, the configuration signal may be a power-on signal and/or a control instruction. As an optional implementation manner, the voltage terminal of the chip 400 may receive the power-on signal transmitted from the image forming apparatus, such that the control unit 410 may configure the installation detecting terminal to be at a low level according to the power-on signal. That is, after the chip 400 receives the power supply from the image forming apparatus, the chip 400 may control the installation detecting terminal to be configured to be at a low level. As another optional implementation manner, the voltage terminal of the chip 400 may receive a control instruction transmitted from the image forming apparatus, such that the control unit 410 may configure the installation detecting terminal to be at a low level according to the control instruction. That is, after the chip 400 receives the control instruction of the image forming apparatus, the chip may control the installation detecting terminal to be configured to be at a low level.

In another optional implementation manner, the control unit 410 may output a control instruction to control the conduction or cutoff of the switch element connected to the control unit 410, such that the installation detecting terminal connected to the switch element may be configured to be at a low level.

In another optional implementation manner, the control unit 410 may receive the configuration signal transmitted from the image forming apparatus and may be triggered to output a detection signal, such that the switch element connected to the control unit 410 may be in conduction or cutoff, thereby configuring the installation detecting terminal connected to the switch element to be at a low level.

After the installation detecting terminal is configured to be at a low level and the installation detecting pin at the side of the image forming apparatus is connected to a high level, and when the installation detecting terminal is in contact with the installation detecting pin, a current loop may be formed between the chip and the image forming apparatus due to the potential difference between the installation detecting terminal and the installation detecting pin. It may determine whether the installation detecting terminal and the installation detecting pin are in a desired contact according to the electrical parameters in the current loop.

Referring to FIG. 8-1, the following describes how to determine whether the chip and the image forming apparatus are in a desired contact according to the electrical parameters of the current loop in detail.

It is assumed that the chip controller may make the installation detecting terminals SDA2 and SCL2 at the chip side output a low level, and two current loops may be formed between the image forming apparatus and the chip. A current loop C1 may include the voltage pin VCC1 of the image forming apparatus, the pull-up resistor R1, the contact resistor RT2, the SDA2 terminal, the GND2 terminal, the contact resistor RT4, and the GND1 terminal; and the other current loop C2 may include the voltage pin VCC1 of the image forming apparatus, the pull-up resistor R2, the contact resistor RT3, the SCL2 terminal, the GND2 terminal, the contact resistor RT4, and the GND1 terminal.

The image forming apparatus may determine whether the electrical parameter of the current loop is within the first preset range. If the electrical parameter of the current loop is not within the first preset range, it may indicate that the image forming apparatus and the chip may be in a poor contact, the communication between the chip and the image forming apparatus may be unstable, and data transmission failures such as data distortion and data interruption may occur. If it is determined that the chip and the image forming apparatus are in a poor contact, the image forming apparatus may report an error, such as a prompt signal to remind the user that the chip and the image forming apparatus are in a poor contact, which may affect data communication. The user may choose to continue the data communication or terminate the data communication and reinstall the consumables corresponding to the chip.

If the electrical parameter of the current loop is within the first preset range, it is determined that the image forming apparatus and the chip may be in a desired contact.

The case where the image forming apparatus and the chip are in a desired contact can be divided into at least two cases. For the first case, the electrical parameter of the current loop is within the first preset range, and the electrical parameter of the current loop is not within the second preset range; and data may be transmitted between the image forming apparatus and the chip, and the communication condition may be desired.

For second case, the electrical parameter of the current loop is within the first preset range, and the electrical parameter of the current loop is within the second preset range; and data may be transmitted between the image forming apparatus and the chip. However, the communication condition may not be desired, and the solution that can be adopted may be to reduce the speed of data transmission between the image forming apparatus and the chip.

When the electrical parameter is voltage, the first preset range and the second preset range may both be preset voltage ranges; when the electrical parameter is current, the first preset range and the second preset range may both be preset current ranges; and when the electrical parameter is resistance, the first preset range and the second preset range may both be preset resistance ranges. Furthermore, when the electrical parameter is a specific voltage value, the first preset range and the second preset range may both be preset voltage value ranges; and when the voltage parameter is a specific number of times of the low levels, the first preset range and the second preset range may both be the ranges of the number of times of the low levels.

How to determine the first preset range and the second preset range may be exemplarily illustrated hereinafter.

If the chip outputs a low-level signal and the image forming apparatus receives a low-level signal, it may indicate that the data transmission between the chip and the image forming apparatus is normal. If the chip outputs a low-level signal and the image forming apparatus receives a high-level signal, it may indicate that the data transmission between the chip and the image forming apparatus is not normal. Therefore, the data transmission between the chip and the image forming apparatus may be not normal due to poor contact between the terminals at the chip side and the pins at the side of the image forming apparatus.

As mentioned above, the electrical parameters may be voltage, current or resistance, which may be described separately below.

For the case where the electrical parameter is voltage:

when the electrical parameter is voltage, specifically, the electrical parameters may refer to the voltage Vda of the installation detecting pin SDA1 and the voltage Vc1 of the installation detecting pin SCL1.

Referring to FIG. 8-1, when the terminal SDA2 at the chip side outputs a low level, the pin SDA1 at the side of the image forming apparatus should also detect a low level. In such case, the data transmission between the chip and the image forming apparatus may be normal. Normally, the low level may be below 0.3VCC1, such that, the first preset range may be 0-0.3VCC1. That is, if the voltage Vda of the installation detecting pin SDA1 and the voltage Vc1 of the installation detecting pin SCL1 are both in the range of 0-0.3VCC1, it may indicate that the chip and the image forming apparatus may be in a desired contact and the data transmission may be normal. The second preset range, included in the first preset range, may be a subset of the first preset range. The second preset range may be set to 0.2VCC1-0.3VCC1, 0.25VCC1-0.3VCC1 0.22VCC1-0.3VCC1, 0.18VCC1-0.3VCC1 or the like according to actual needs.

In various embodiments of the present disclosure, the voltage may be selected as the electrical parameter, and whether the installation detecting pin and the installation detecting terminal are in a desired contact may be determined according to the voltage. The specific process may be: the voltage Vda of the installation detecting pin SDA1, and the voltage Vc1 of the installation detecting pin SCL1 may be detected; if the voltage Vda of the installation detecting pin SDA1 and the voltage Vc1 of the installation detecting pin SCL1 are both in the range of 0-0.3VCC1, it may indicate that the chip and the image forming apparatus may be in a desired contact and the data transmission may be normal.

Furthermore, in the detection stage of whether the chip and the image forming device are in a desired contact, that is, when a current loop is formed between the chip and the image forming apparatus, multiple electrical parameter detections may be performed. If the number of times of the low-level signals received by the image forming apparatus meets expectation, it is determined that the chip and the image forming apparatus may be in a desired contact and the data transmission between the chip and the image forming apparatus may be normal. If the number of times of the low-level signals received by the image forming apparatus does not meet expectation, it is determined that the chip and the image forming apparatus may not be in a desired contact and the data transmission between the chip and the image forming apparatus may be not normal.

Referring to FIG. 8-1, when the terminal SDA2 at the chip side outputs a low level, the pin SDA1 at the side of the image forming apparatus should also detect a low level; and even if the electrical parameter detection is performed multiple times (assumed to be M times), the number of times that the pin SDA1 at the side of the image forming device detects the low levels should also meet expectations. In such case, the data transmission between the chip and the image forming apparatus may be normal. Therefore, the first preset range may be L-M. That is, if the number of times that the voltage Vda of the installation detecting pin SDA1 and the voltage Vc1 of the installation detecting pin SCL1 are low levels is within the range of L-M, it may indicate that the chip and the image forming apparatus may be in a desired contact and the data transmission may be normal. The second preset range, included in the first preset range, may be a subset of the first preset range. The second preset range may be set to L-(M-1), L-(M-2) and the like according to actual needs which may not be limited herein, where L is less than M.

For example, if the above-mentioned M is 9, L is 5, and the second preset range is set to L-(M-2), such that if it is determined that the number of times that the voltage Vda of the installation detecting pin SDA1 and the voltage Vc1 of the installation detecting pin SCL1 are low levels is greater than or equal to 5, and less than or equal to 9, it may determine that the chip and the image forming apparatus are in a desired contact, and the data transmission may be normal. If the number of times that the voltage Vda of the installation detecting pin SDA1 and/or the voltage Vc1 of the installation detecting pin SCL1 are low levels is less than 5, it may determine that the chip and the image forming apparatus are in a poor contact, and the data transmission may be not normal. Furthermore, if it is determined that the number of times that the voltage Vda of the installation detecting pin SDA1 and the voltage Vc1 of the installation detecting pin SCL1 are low levels is greater than or equal to 5, and less than or equal to 7, it may determine that the chip and the image forming apparatus are in a desired contact, but the communication state may be not desired; and the adopted solution may be to reduce the speed of data transmission between the image forming apparatus and the chip. If it is determined that the number of times that the voltage Vda of the installation detecting pin SDA1 and the voltage Vc1 of the installation detecting pin SCL1 are low levels is greater than 7, and less than or equal to 9, it may determine that the chip and the image forming apparatus are in a desired contact, and communication state may be desired.

For the case where the electrical parameter is resistance: the voltage of the installation detecting pin SDA1 is:

$$Vda=VCC1*[(RT2+RT4)/(R1+RT2+RT4)] \quad (1)$$

and the voltage of the installation detecting pin SCL1 is:

$$Vc1=VCC1*[(RT3+RT4)/(R2+RT3+RT4)] \quad (2)$$

The resistance values of R1 and R2 may be relatively large which may be normally several thousand ohms, and the saturated conduction-resistance of the first switch element SW1 and the second switch element SW2 may be equal to zero. For the case that the installation detecting pin is in a desired contact with the installation detecting terminal, the values of the contact resistors RT2, RT3 and RT4 may be relatively small which may be normally a few hundred ohms, less than one hundred ohms, or even close to zero. For the case that the installation detecting pin is in a poor contact with the installation detecting terminal, the values of the contact resistors RT2, RT3 and RT4 may be relatively large, which may reach thousands of ohms.

Vda=0.3VCC1 may be substituted into formula (1); and since the value of R1 is given, the value of RT2+RT4 may be calculated. For the convenience of description, it is assumed that the calculated value of RT2+RT4 is R01. When the electrical parameter is resistance, for the current loop C1, the first preset range may be (0, R01). That is, when the value of RT2+RT4 of the current loop C1 is within (0, R01), the installation detecting pin SDA1 may be in a desired contact with the installation detecting terminal SDA2.

Vc1=0.3VCC1 may be substituted into formula (2); and since the value of R2 is known, the value of RT3+RT4 may be calculated. For the convenience of description, it is assumed that the calculated value of RT3+RT4 is R02. When the electrical parameter is resistance, for the current loop C2, the first preset range may be (0, R02). That is, when the value of RT3+RT4 of the current loop C2 is within (0, R02), the installation detecting pin SCL1 may be in a desired contact with the installation detecting terminal SCL2.

In various embodiments of the present disclosure, the resistance may be selected as the electrical parameter, and whether the installation detecting pin and the installation detecting terminal are in a desired contact may be determined based on the resistance. The specific process may be: the voltage of the installation detecting pin SDA1, the voltage of the installation detecting pin SCL1, and the currents in the current loop C1 and the current loop C2 may be respectively measured; the voltage of the installation detecting pin SDA1 may be divided by the current in the loop C1, and if the value obtained is between (0, R01), it may indicate that the installation detecting pin SDA1 is in a desired contact with the installation detecting terminal SDA2; and the voltage of the installation detecting pin SCL1 may be divided by the current in the loop C2, and if the value obtained is between (0, R02), it may indicate that the installation detecting pin SCL1 is in a desired contact with the installation detecting terminal SCL2.

For the case where the electrical parameter is current:

when the electrical parameter is current, specifically, the electrical parameter refers to the currents in the current loop C1 and the current loop C2.

For the convenience of description, the current in the current loop C1 is referred as I1, and the current in the current loop C2 is referred as I2:

$$I1=VCC1/(R1+RT2+RT4) \quad (3)$$

$$I2=VCC1/(R2+RT3+RT4) \quad (4)$$

RT2+RT4=R01 may be substituted into formula (3) to obtain formula (5):

$$I1=VCC1/(R1+R01) \quad (5)$$

RT3+RT4=R02 may be substituted into formula (4) to obtain formula (6):

$$I2=VCC1/(R2+R02) \quad (6)$$

RT2+RT4=0 may be substituted into formula (3) to obtain formula (7):

$$I1=VCC1/R1 \quad (7)$$

RT3+RT4=0 may be substituted into formula (4) to obtain formula (8):

$$I2=VCC1/R2 \quad (8)$$

I1 calculated according to formula (5) is referred as I01, 12 calculated according to formula (6) is referred as I02, I1 calculated according to formula (7) is referred as I03, and 12 calculated according to formula (8) is referred as I04.

For the current loop C1, the first preset range may be (I01, I03). That is, when the current value of the current loop C1 is within (I01, I03), the installation detecting pin SDA1 may be in a desired contact with the installation detecting terminal SDA2.

For the current loop C2, the first preset range may be (I02, I04). That is, when the current value of the current loop C2 is within (I02, I04), the installation detecting pin SCL1 may be in a desired contact with the installation detecting terminal SCL2.

In various embodiments of the present disclosure, the current may be selected as the electrical parameter, and whether the installation detecting pin and the installation detecting terminal are in a desired contact may be determined based on the current. The specific process may be: the current of the current loop C1 may be detected, and if the current of the current loop C1 is within (I01, I03), it may indicate that the installation detecting pin SDA1 is in a desired contact with the installation detecting terminal SDA2; and the current of the current loop C2 may be detected, and if the current of the current loop C2 is within (I02, I04), it may indicate that the installation detecting pin SCL1 is in a desired contact with the installation detecting terminal SCL2.

When the electrical parameters are respectively resistance and current, the calculation approach of the second preset range may be similar to the calculation approach of the first preset range, which may not be described in detail herein.

The above-mentioned descriptions may be merely optional embodiments of the present disclosure and may not be used to limit the present disclosure. For those skilled in the art, the present disclosure may have various modifications and changes. Any modification, equivalent replacement, improvement and the like made within the spirit and principle of the present disclosure should be included in the protection scope of the present disclosure.

What is claimed is:

1. An electrical parameter detection method, applied to an image forming apparatus and a chip, wherein the image forming apparatus is detachably installed with a consumable; the consumable is installed with the chip; the image forming apparatus includes an installation detecting pin and an image forming control unit; and the chip includes an installation detecting terminal and a chip control unit, the method comprising:

configuring, by the image forming control unit, the installation detecting pin to be at a high level;

controlling, by the chip control unit, a voltage of the installation detecting terminal to be at a low level directly, such that a current loop is formed between the image forming apparatus and the chip; and determining, by the image forming apparatus, whether the image forming apparatus is in a desired contact with the chip according to an electrical parameter of the current loop.

2. The method according to claim 1, wherein the chip further includes a switch element and a ground (GND) terminal; a first end of the switch element is connected to the installation detecting terminal; a second end of the switch element is connected to the GND terminal; and the chip control unit controls the voltage of the installation detecting terminal to be at the low level, including:

controlling the switch element to be in conduction by the chip control unit, wherein when the switch element is in a conduction state, the installation detecting terminal is in a conducting state to the GND terminal, such that the voltage of the installation detecting terminal is at the low level.

3. The method according to claim 2, wherein controlling the switch element to be in conduction by the chip control unit includes:

receiving a configuration signal transmitted from the image forming apparatus by the chip, and controlling the switch element to be in conduction according to the configuration signal by the chip control unit.

4. The method according to claim 3, wherein the chip further includes a voltage terminal and the configuration signal includes a power-on signal; and receiving the configuration signal transmitted from the image forming apparatus by the chip and controlling the switch element to be in conduction according to the configuration signal by the chip control unit includes:

receiving the power-on signal transmitted from the image forming apparatus by the voltage terminal of the chip and controlling the switch element to be in conduction according to the power-on signal by the chip control unit.

5. The method according to claim 3, wherein the configuration signal includes a control instruction; and receiving the configuration signal transmitted from the image forming apparatus by the chip and controlling the switch element to be in conduction according to the configuration signal by the chip control unit includes:

receiving the control instruction transmitted from the image forming apparatus by the chip and controlling the switch element to be in conduction according to the control instruction by the chip control unit.

6. The method according to claim 3, wherein the configuration signal includes a synchronization signal; and receiving the configuration signal transmitted from the image forming apparatus by the chip and controlling the switch element to be in conduction according to the configuration signal by the chip control unit includes:

receiving the synchronization signal transmitted from the image forming apparatus by the chip, and controlling the switch element to be in conduction according to the synchronization signal by the chip control unit.

7. The method according to claim 1, further including:

the image forming control unit configuring the installation detecting pin to be at the high level and the chip control unit controlling the voltage of the installation detecting terminal to be at the low level, each being executed N times, wherein N is a natural number greater than or equal to 2, a current loop is determined for each of the N times, and each current loop corresponds to an electrical parameter, wherein:

determining, by the image forming apparatus, whether the image forming apparatus is in the desired contact with the chip according to the electrical parameter of the current loop includes:

calculating an average value of N electrical parameters; and determining, by the image forming apparatus, whether the image forming apparatus is in the desired contact with the chip according to the average value of the N electrical parameters.

8. The method according to claim 1, wherein:

after the image forming apparatus determines that the image forming apparatus is in the desired contact with the chip according to the electrical parameter of the current loop, the image forming apparatus reads information stored in the chip, and/or the image forming apparatus writes information to the chip.

9. The method according to claim 1, wherein determining, by the image forming apparatus, whether the image forming apparatus is in the desired contact with the chip according to the electrical parameter of the current loop includes:

determining, by the image forming apparatus, whether the electrical parameter of the current loop is within a first preset range; and if the electrical parameter of the current loop is within the first preset range, determining that the image forming apparatus is in the desired contact with the chip by the image forming apparatus.

10. The method according to claim 9, wherein the method further includes: if the electrical parameter of the current loop is within the first preset range, and the electrical parameter of the current loop is within a second preset range, reducing a speed of data transmission between the image forming apparatus and the chip, wherein the second preset range is included in the first preset range.

11. The method according to claim 9, wherein the method further includes: if the electrical parameter of the current loop is not within the first preset range, reporting an error by the image forming apparatus.

12. The method according to claim 1, wherein when the current loop is formed between the image forming apparatus and the chip, the image forming apparatus performs multiple electrical parameter detections; and determining, by the image forming apparatus, whether the image forming apparatus is in the desired contact with the chip according to the electrical parameter of the current loop includes:

acquiring a number of times of detections of low levels by the image forming control unit; and determining, by the image forming apparatus, whether the image forming apparatus is in the desired contact with the chip according to the number of times of detections of the low levels by the image forming control unit.

13. A chip, wherein the chip is installed on a consumable, the consumable is detachably installed on an image forming apparatus, and the image forming apparatus includes an installation detecting pin, wherein the chip includes:

an installation detecting terminal, configured to be connected with the installation detecting pin of the image forming apparatus; and a chip control unit, configured to directly control a voltage of the installation detecting terminal to be at a low level, such that a current loop is formed between the image forming apparatus and the chip.

14. The chip according to claim 13, wherein the chip further includes:

a ground (GND) terminal; and a switch element, wherein a first end of the switch element is connected to the installation detecting terminal, and a second end of the switch element is connected to the GND terminal.

15. The chip according to claim 14, wherein the chip is further configured to receive a configuration signal transmitted from the image forming apparatus, and the chip control unit is configured to control the switch element to be in conduction according to the configuration signal.

16. The chip according to claim 15, wherein the chip further includes a voltage terminal and the configuration signal includes a power-on signal; and the voltage terminal is electrically connected to the image forming apparatus to receive the power-on signal transmitted by the image forming apparatus; and the chip control unit is further configured to control the switch element to be in conduction according to the power-on signal transmitted by the image forming apparatus.

17. The chip according to claim 15, wherein the configuration signal includes a control instruction;

the chip is further configured to receive the control instruction transmitted from the image forming apparatus; and the chip control unit is further configured to control the switch element to be in conduction according to the control instruction.

18. The chip according to claim 15, wherein the configuration signal includes a synchronization signal;

the chip is further configured to receive the synchronization signal transmitted from the image forming apparatus; and the chip control unit is further configured to control the switch element to be in conduction according to the synchronization signal.

19. A consumable, comprising:

a housing;

a developer container, which is located in the housing and configured to contain developer; and the chip according to claim 13.

20. The consumable according to claim 19, wherein the consumable further includes:

a developer transport element, configured to transport the developer.

21. The consumable according to claim 20, wherein the consumable further includes:

a photosensitive drum; and a charging roller, configured to charge the photosensitive drum.

22. A consumable, wherein the consumable further includes:

a photosensitive drum;

a charging roller, configured to charge the photosensitive drum; and the chip according to claim 13.

* * * * *